US005234728A

United States Patent [19]

Chiang

[11] Patent Number: 5,234,728

[45] Date of Patent: Aug. 10, 1993

[54] FOUNTAIN DEVICE

[76] Inventor: Ming-Ann Chiang, No. 6, Lane 63, Sec. 2, Tan-Hsing Rd., Tan-Tzu Hsiang, Taichung Hsien, Taiwan

[21] Appl. No.: 833,954

[22] Filed: Feb. 11, 1992

[51] Int. Cl.[5] ..... F21P 7/00

[52] U.S. Cl. ..... 428/13; 40/406; 362/96; 362/806; 428/15

[58] Field of Search ..... 428/13, 15; 40/406, 40/407; 119/5; 362/96, 101, 806

[56] References Cited

U.S. PATENT DOCUMENTS 4,081,666 3/1978 Roehrick ..... 428/13 X 4,352,149 9/1982 Stetler ..... 428/13 X

*Primary Examiner*—Henry F. Epstein

*Attorney, Agent, or Firm*—Baker & Botts

[57] ABSTRACT

The fountain device includes a casing with a plurality of pipes and a pump connected to the pipes from which spouts of water gush out to provide visual effects. An illuminating device and a music producing device are provided in the casing. The casing has an artificial three dimensional landscape within the same and a programmable panel which automatically controls the overall operations of the illuminating device and the music producing device.

13 Claims, 4 Drawing Sheets

FOUNTAIN DEVICE

TECHNICAL FIELD OF THE INVENTION

The invention relates to a fountain device, more particularly to one which is to be provided indoors for aesthetic pleasure of a viewer, producing the effects of a real fountain outdoors.

BACKGROUND OF THE INVENTION

There are a lot of artificial or man-made recreation centers for urban dwellers who are unable to go out of the towns to enjoy natural landscapes and green pastures due to shortage of spare time. Modern technology has added a number of mentally and visually pleasing devices to those artificial recreation means, such as aquariums with multiple illuminating bulbs and the like.

Mankind by nature prefers to live in a surrounding where there is an abundance of beautiful landscapes, forests, rivers and green pastures. Where there is a lack of natural things, mankind builds artificial ones as a substitute to satisfy the thirst for natural beauty.

In a country where land is scarce and precious, artificial gardens with green pastures and fountains are built to enhance the aesthetic pleasure of urban dwellers. However, city dwellers can go to such places only on holidays and when they have spare time. They are usually tied up in their offices or homes most of the time, and thus are unable to benefit from these mind refreshing scenes.

SUMMARY OF THE INVENTION

The main object of the present invention is to provide a fountain device which is made in combination with an artificial landscape and modern technology to provide aesthetically pleasing effects to urban dwellers.

Another object of the present invention is to provide a fountain device which is to be kept indoors so that the indoor occupant can enjoy the natural scenery without having to go out of the town.

According to the present invention, a fountain device includes a casing having a front section, a rear section higher than the front section (17) and a bottom section which has a receiving space with water therein. The bottom section is in communication with the rear section. A pipe means with a predetermined number of spouts is provided in the receiving space of the bottom section. An illuminating device is provided in the casing according to pre-arranged positions. A pump means is provided in the casing and is connected to the pipe means in an operative manner. A music providing means is disposed at the front section (17) of the casing. A programmable control panel is disposed at the front section (17) of the casing. The front section also has a switch actuation which automatically controls the overall operations of the music providing means, the illuminating device and the pump means. The casing also has an opening through which water can be poured into the same and a water level indicator.

BRIEF DESCRIPTION OF THE DRAWINGS

Other features and advantages of the present invention will become apparent in the following detailed description, including drawings, all of which show a non-limiting form of the present invention, and in which.

DETAILED DESCRIPTION OF THE INVENTION

Figure 1:
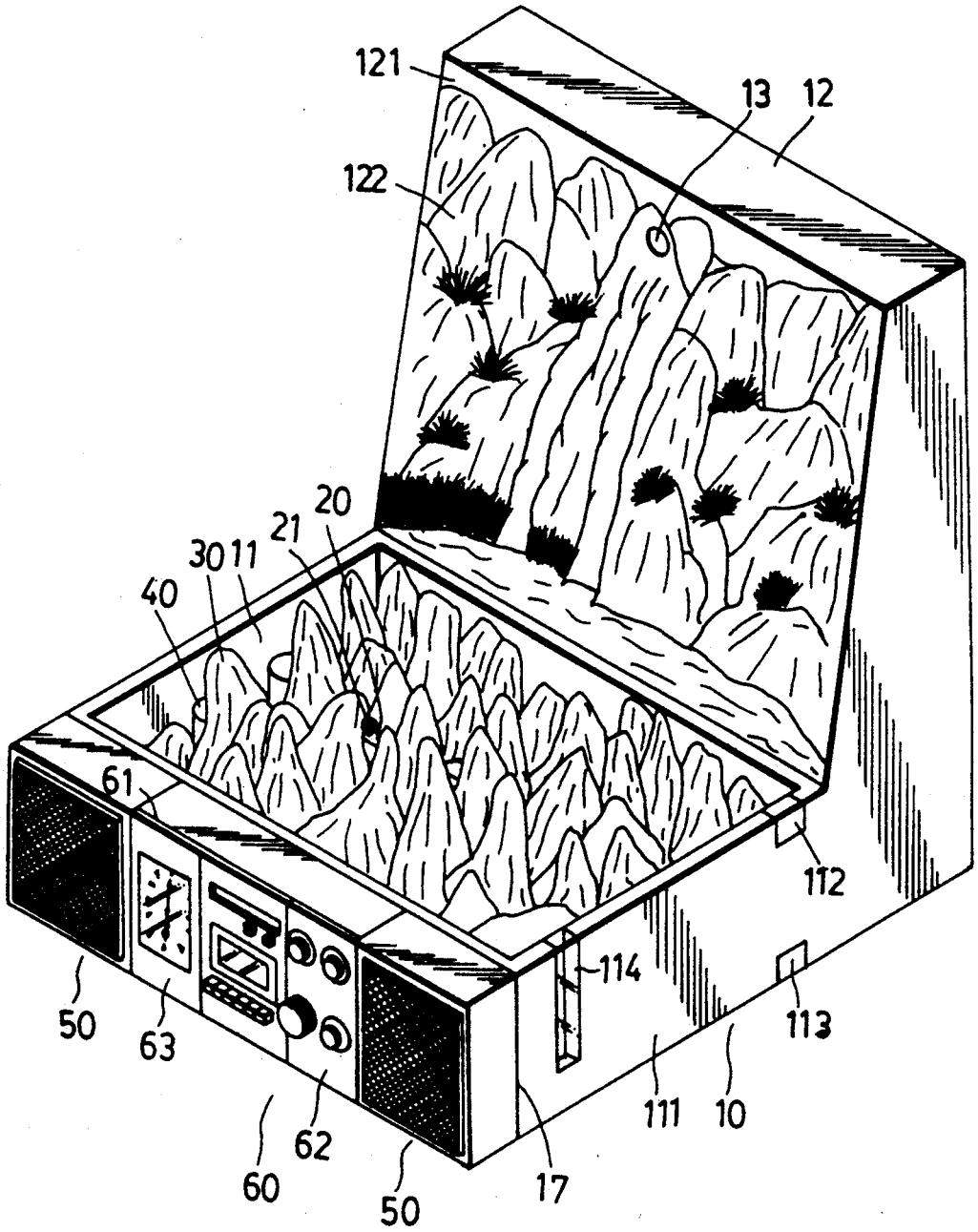
FIG. 1 shows a preferred embodiment of a fountain device of the present invention.
Figure 2:
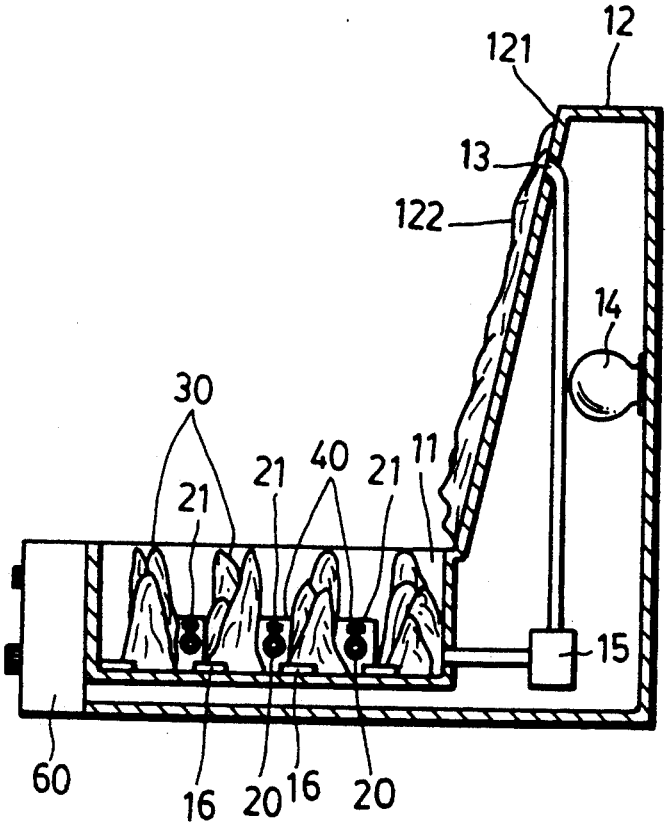
FIG. 2 is a side view of FIG. 1.
Figure 3:
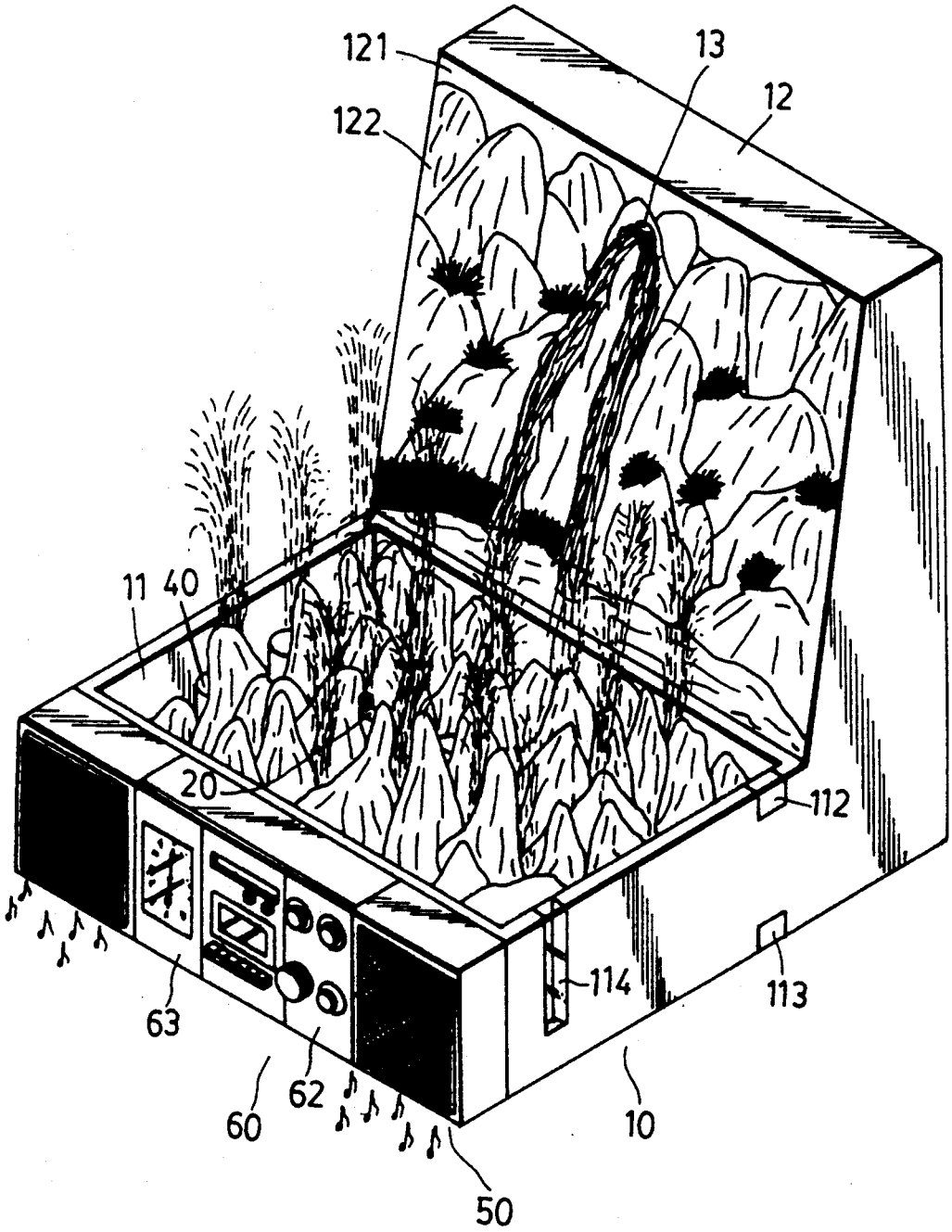
FIG. 3 shows the fountain device of FIG. 1 in operation.
Figure 4:
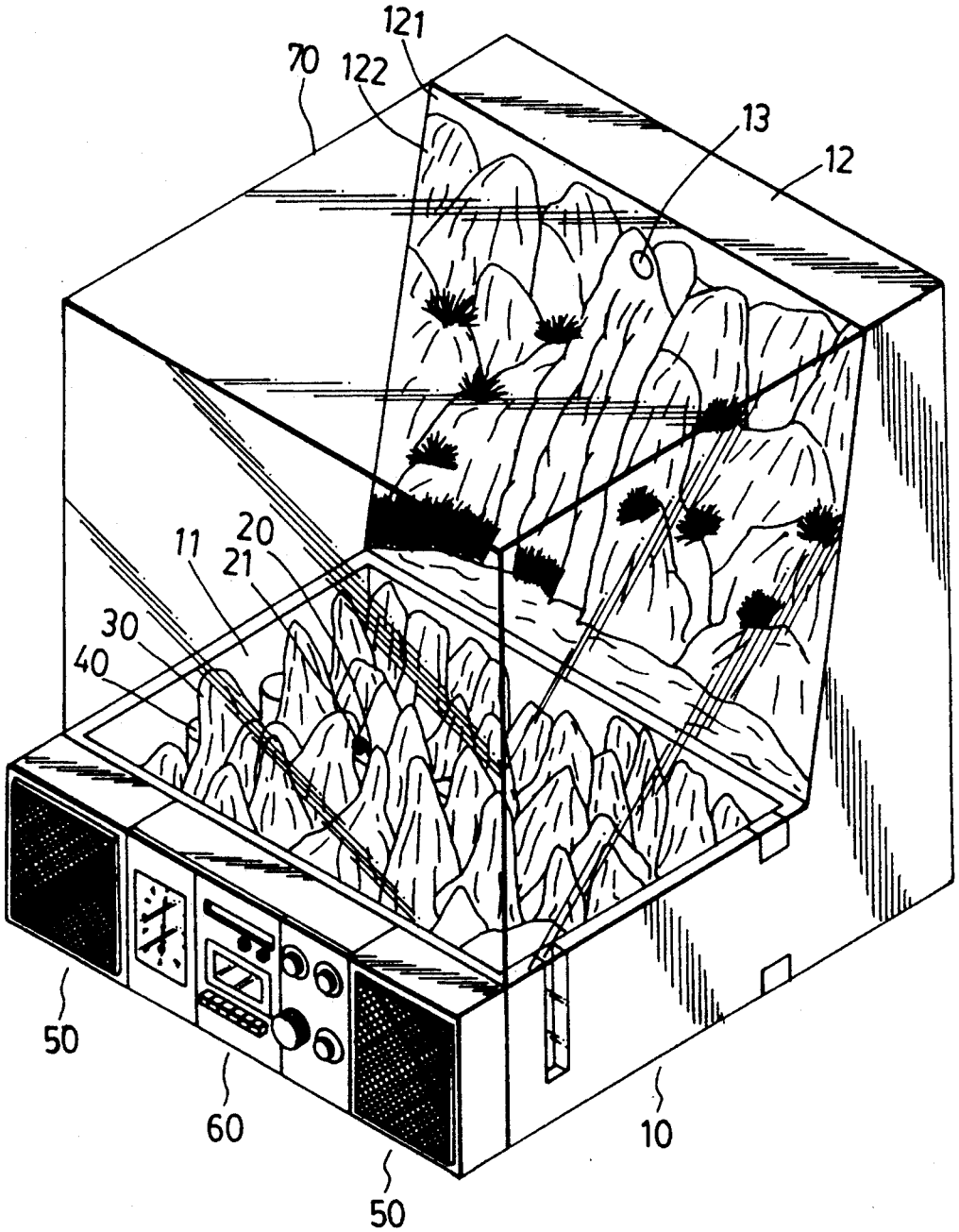
FIG. 4 shows another preferred embodiment of the fountain device of the present invention.

Referring to FIGS. 1 and 2, a fountain device of the present invention is shown to comprise a casing (10), a pipe means (20), an artificial landscape means (30), a pump means (40), a music providing means (50) and a programmable control panel (60).

The casing (10) includes a front section (17) and a rear section (12) higher than the front section (17) and a bottom section with a receiving space (11) between the front and rear sections. On one side (111) of the receiving space, there is an inlet (112) and an outlet (113) for the water to get into and out of the casing (10). A water level indicator (114) is provided at one corner of the casing (10). The rear section is in communication with the receiving space.

The rear section (12) of the casing (10) has a plate (121) which is inclined relative to the receiving space (11) of the bottom section. An artificial three dimensional landscape (122) is disposed on the inclined plate (121) and another artificial three dimensional landscape (30) is provided in the receiving space (11) of the bottom section as shown in FIG. 2. A pipe means (20) with a predetermined number of spouts (21) is disposed in the receiving space (11) of the bottom section in a scattered manner so that the artificial three dimensional landscape (30) shields the pipe means (20) from the view of an onlooker who is outside of the casing (10). The pipe means (20) in the preferred embodiment includes three rows provided in the receiving space (11) in a parallel manner. They can be arranged in any manner and arrangement.

A pump means (15) and an illuminating device (14) can be disposed in the casing (10) in any desire arrangement and each respectively connects to the pipe means (20) in an operative manner. A spout (13) connected to the pump means (15) is disposed on the inclined plate (121) at the rear section (12) of the casing (10).

A music producing device (50) is disposed at the front section (17) of the casing. A programmable control panel (60) together with a control switch (62) is provided at the front section (17) of the casing (10). Of course, the control panel (60) includes circuit boards which are well known in the art, so that detailed description of such art is not necessary here. It is important to note that the overall operations of the pump means (15) and music producing device are respectively programmed such that the illuminating device (14) can be a multi-colored one some of which lights (16) are provided in the receiving space (11) and which can become brighter or dimmer or change into different colors according to the rise and fall of the music. The gushing water from the spouts (21,13) of the pipe means (20) also changes according to the music tones.

In short, the present invention uses all types of well known art in the electronic field in order to make the fountain device so that the fountain device can provide a variety of amusing and visual effects to the viewer. Since it is meant to be kept indoors, a transparent top cover (70) can be provided at the top portion of the casing (10) so that water cannot spill over it. A clock (63) can also be disposed at the front section (17) of the casing (10).

With the invention thus explained, it is obvious to those skilled in the art that various modifications and variations can be made without departing from the scope and spirit of the present invention. It is therefore intended that this invention is to be limited only as in the appended claims.

What is claimed is:

1. A fountain device characterized by:

a casing including a water receiving space and an opening through which water can be poured into said receiving space;

a first artificial landscape provided in said receiving space;

a plurality of pipes, each of which has a predetermined number of spouts provided in said receiving space according to pre-arranged positions;

a pump unit provided in said casing and connected to said plurality of pipes in an operative manner;

a music producing device provided at a front portion of said casing;

a programmable control panel provided at said front portion of said casing which automatically controls the overall operations of said pump unit and said music producing device; and a switch actuation which operates said control panel.

2. A fountain device as claimed in claim 1, characterized in that said casing further includes an illuminating device provided in said casing in a pre-arranged position said first artificial landscape provided in said receiving space being three dimensional, said plurality of pipes being disposed within said three dimensional landscape in a scattered manner.

3. A fountain device as claimed in claim 2, characterized in that said first artificial three dimensional landscape has a height higher than the height of said plurality of pipes, shielding said plurality of pipes from being visible outside of said casing.

4. A fountain device as claimed in claim 2, characterized in that said casing includes a rear portion having a plate with a second artificial three dimensional landscape thereon, said plate being inclined relative to said receiving space.

5. A fountain device as claimed in claim 2, characterized in that said casing further includes an indicator which shows the amount of water inside the same.

6. A fountain device as claimed in claim 1, characterized in that said casing further includes a transparent top cover enclosing the same.

7. A fountain device characterized by:

a casing including a water receiving space and an opening through which water can be poured into said receiving space;

a plurality of pipes, each of which has a predetermined number of spouts provided in said receiving space according to pre-arranged positions;

a pump unit provided in said casing and connected to said plurality of pipes in an operative manner;

a music producing device provided at a front portion of said casing;

a first artificial three-dimensional landscape provided in said receiving space with said plurality of pipes being disposed within said three dimensional landscape in a scattered manner; and a programmable control panel provided at said front portion of said casing which automatically controls the overall operations of said pump unit and said music producing device.

8. A fountain device as claimed in claim 7, characterized in that said casing further includes an illuminating device provided in said casing in a pre-arranged position.

9. A fountain device as claimed in claim 7, characterized in that said first artificial three dimensional landscape has a height higher than the height of said plurality of pipes, shielding said plurality of pipes from being visible outside of said casing.

10. A fountain device as claimed in claim 7, characterized in that said casing further includes an indicator which shows the amount of water inside the same.

11. A fountain device as claimed in claim 7, characterized in that said casing includes a rear portion having a plate with a second artificial three dimensional landscape thereon, said plate being inclined relative to said receiving space.

12. A fountain device as claimed in claim 7, characterized in that said casing further includes a transparent top cover enclosing the same.

13. A fountain device as claimed in claim 7, characterized in that said casing further includes a switch actuation which operates said control panel.

* * * * *

UNITED STATES PATENT AND TRADEMARK OFFICE

CERTIFICATE OF CORRECTION

PATENT NO. : 5,234,728

DATED : Aug. 10, 1993

INVENTOR(S) : Chiang

It is certified that error appears in the above-identified patent and that said Letters Patent is hereby corrected as shown below:

Column 3, line 32, after "tion", insert --, --.

Column 4, line 1, after "claimed in", delete "claim 2" and insert --claim 1--.

Signed and Sealed this

Seventh Day of June, 1994

Bruce Lehman

*Attest:*

BRUCE LEHMAN

*Attesting Officer*

*Commissioner of Patents and Trademarks*